US009725211B2

(12) United States Patent
Tan

(10) Patent No.: US 9,725,211 B2
(45) Date of Patent: Aug. 8, 2017

(54) TRI-FOLD SIDE SEAMED PLASTIC PRODUCE BAG AND METHOD FOR MAKING SAME

(71) Applicant: Greg Tan, Harahan, LA (US)

(72) Inventor: Greg Tan, Harahan, LA (US)

( * ) Notice: Subject to any disclaimer, the term of this patent is extended or adjusted under 35 U.S.C. 154(b) by 677 days.

(21) Appl. No.: 14/263,794

(22) Filed: Apr. 28, 2014

(65) Prior Publication Data

US 2014/0270593 A1 Sep. 18, 2014

Related U.S. Application Data

(62) Division of application No. 13/566,491, filed on Aug. 3, 2012, now Pat. No. 8,708,879.

(51) Int. Cl.

| | |
|---|---|
| ***B65D 30/00*** | (2006.01) |
| ***B65D 30/10*** | (2006.01) |
| ***B65D 33/00*** | (2006.01) |
| ***B31B 29/74*** | (2006.01) |
| ***B31B 19/00*** | (2006.01) |

(52) U.S. Cl.

CPC ..... *B65D 31/16* (2013.01); *B31B 19/00* (2013.01); *B31B 29/74* (2013.01); *B65D 33/002* (2013.01); *B65D 33/007* (2013.01); *B31B 2219/146* (2013.01); *B31B 2219/88* (2013.01); *B31B 2237/10* (2013.01); *B31B 2237/60* (2013.01)

(58) Field of Classification Search

CPC ..... B65D 31/16; B65D 33/002; B65D 33/007
USPC ..... 383/37; 428/35.2; 206/554
See application file for complete search history.

(56) References Cited

U.S. PATENT DOCUMENTS

| | | | | |
|---|---|---|---|---|
| 5,435 | A | 2/1848 | Punch | |
| 2,444,685 | A | 7/1948 | Waters | |
| 3,115,295 | A | 12/1963 | Nash | |
| 3,448,915 | A | 6/1969 | Schwarzkopf | |
| 3,469,769 | A | 9/1969 | Guenther | |
| 3,605,571 | A | 9/1971 | Titchenal | |
| 3,749,237 | A | 7/1973 | Dorton | |
| 3,931,886 | A | 1/1976 | Yamauchi | |
| 3,979,050 | A * | 9/1976 | Cilia | B65D 33/002 206/390 |
| 4,106,395 | A | 8/1978 | Rochla | |
| 4,164,170 | A | 8/1979 | Nordin | |
| 4,363,437 | A | 12/1982 | Scherz | |
| 4,802,582 | A * | 2/1989 | Johnson | B26D 3/14 206/390 |

(Continued)

*Primary Examiner* — Jes F Pascua
(74) *Attorney, Agent, or Firm* — David A. Belasco; Belasco, Jacobs & Townsley, LLP

(57) ABSTRACT

A trifold side seamed film produce bag includes a front wall and a back wall, first and second side edges sealed together and a seamless bag bottom. The bag is joined at the side edges to additional bags by a perforation. The bag is corona treated on at least one wall and promotional material is printed on the treated surface. The bags are folded to one third of their height to fit compact bag roll dispensers. The bags are folded in a Z-fold or C-fold configuration. The method includes manufacturing the bags and winding them onto cores or forming the bags into coreless rolls. An apparatus for forming the side seamed bags includes an extruder, a tubing flattener, a perforator, a sealer, a corona treater, a printer and a slitter. The treated, printed bags may be stored on rolls for later slitting into two bag streams and folding into thirds.

1 Claim, 15 Drawing Sheets

(56) References Cited

U.S. PATENT DOCUMENTS

| | | | | |
|---|---|---|---|---|
| 4,811,418 | A | | 3/1989 | Reifenhauser |
| 5,096,305 | A | | 3/1992 | Rimondi et al. |
| 5,573,489 | A | | 11/1996 | Letendre et al. |
| 5,611,627 | A | | 3/1997 | Belias et al. |
| 5,709,641 | A | * | 1/1998 | Vaquero ..... B31B 19/00 493/195 |
| 5,890,810 | A | | 4/1999 | Barlow |
| 5,941,393 | A | | 8/1999 | Wilfong, Jr. |
| 5,967,663 | A | | 10/1999 | Vaquero et al. |
| 6,159,136 | A | | 12/2000 | Belias et al. |
| 6,183,132 | B1 | | 2/2001 | Simhaee |
| 6,196,717 | B1 | | 3/2001 | Belias et al. |
| 6,286,680 | B1 | | 9/2001 | Hofrichter |
| 6,379,292 | B1 | | 4/2002 | Simhaee |
| 6,488,222 | B1 | | 12/2002 | West et al. |
| 7,104,942 | B2 | | 9/2006 | Tan |

* cited by examiner

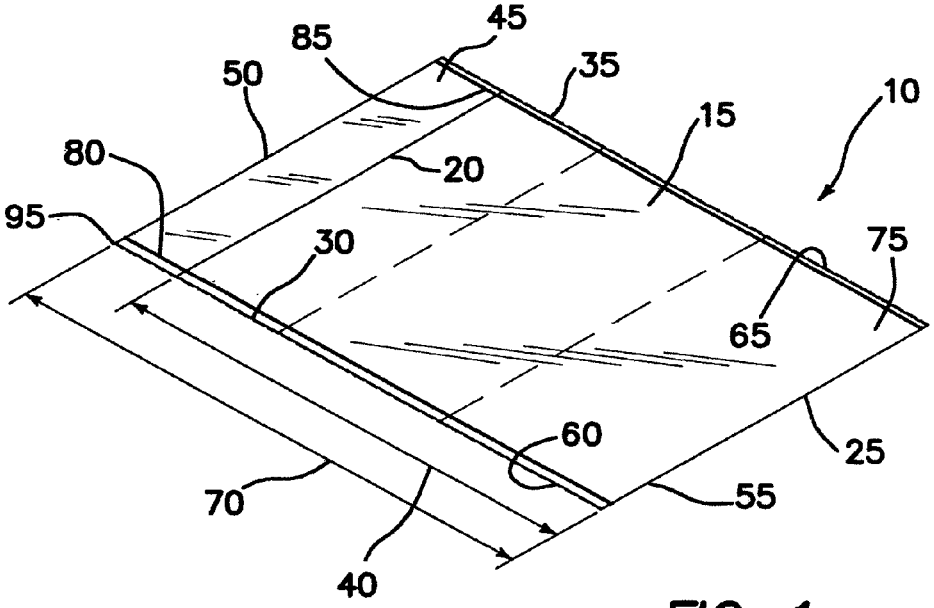
FIG. 1
FIG. 1A
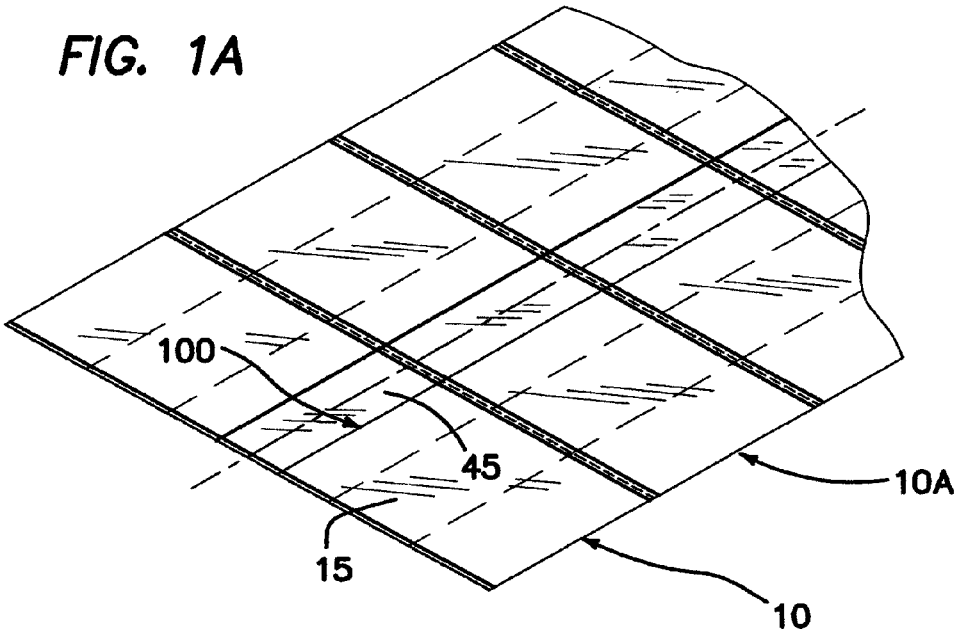

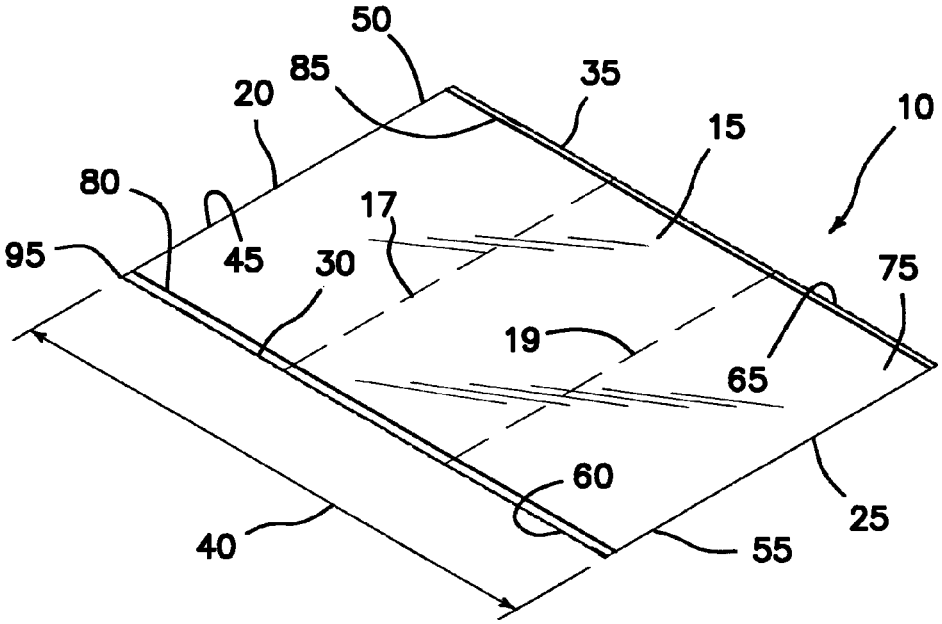
FIG. 17
FIG. 17A
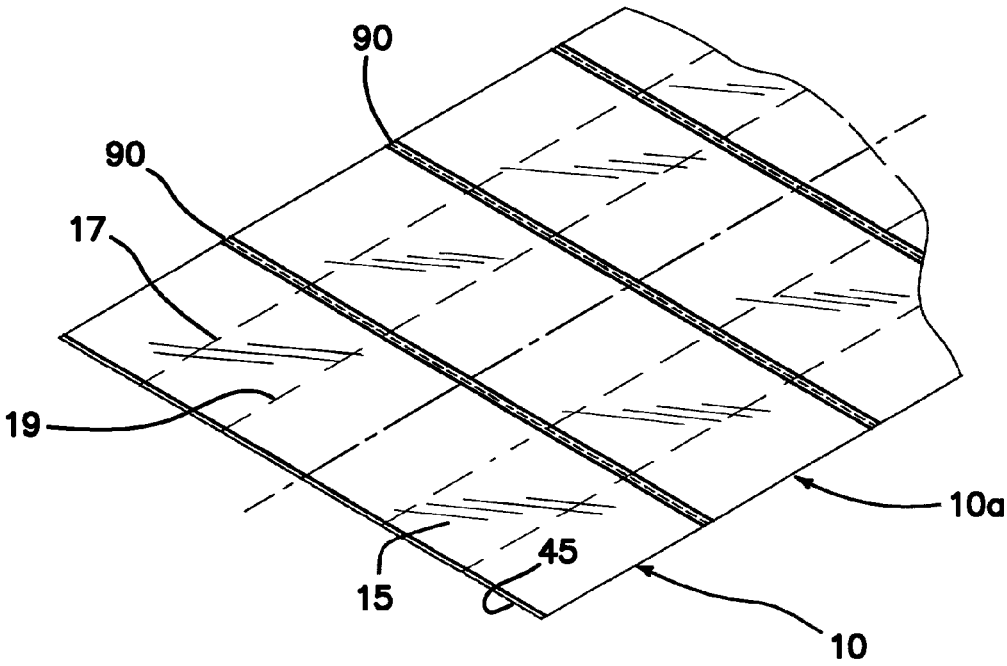

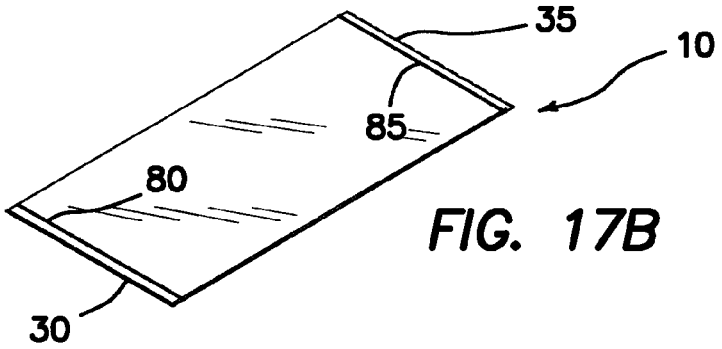
FIG. 17B
FIG. 22
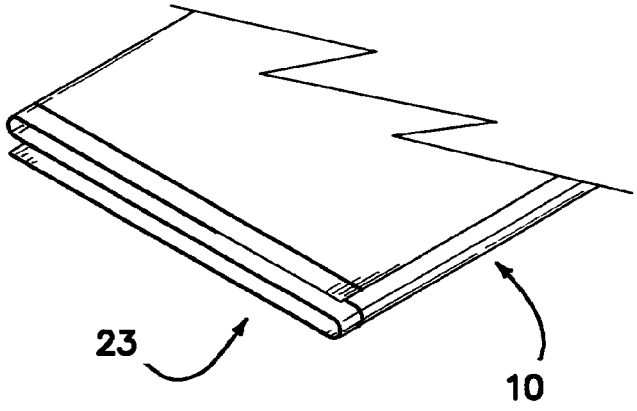
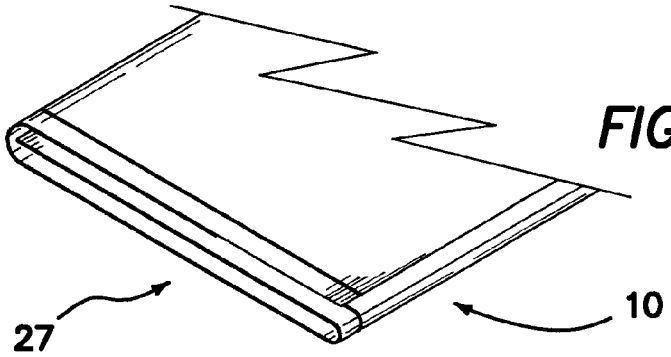
FIG. 23

FIG. 20
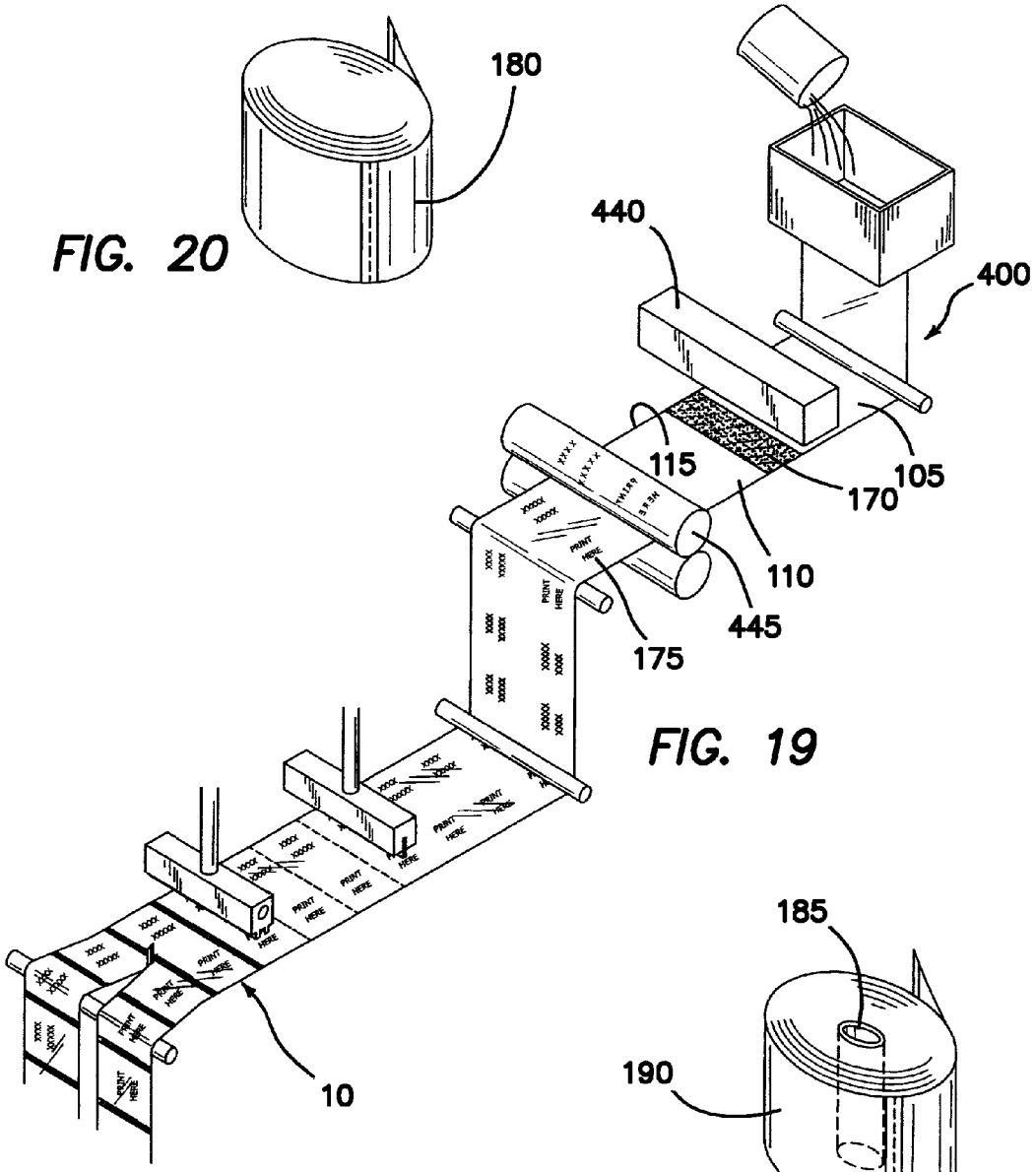
FIG. 19
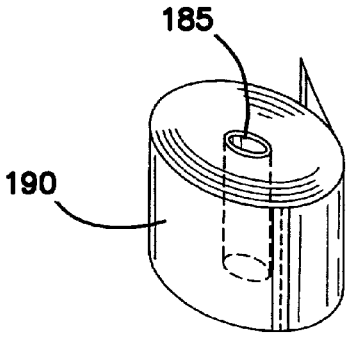
FIG. 21

TRI-FOLD SIDE SEAMED PLASTIC PRODUCE BAG AND METHOD FOR MAKING SAME

RELATED APPLICATIONS

The instant application is a divisional of U.S. application Ser. No. 13/566,491, filed Aug. 3, 2012 and currently pending, which is a continuation of U.S. application Ser. No. 13/101,946, filed May 5, 2011, issued as U.S. Pat. No. 8,317,670, which is a divisional of U.S. application Ser. No. 11/829,017, filed Jul. 26, 2007, issued as U.S. Pat. No. 7,963,898.

FIELD OF INVENTION

The invention pertains to plastic film produce bags. More particularly, the invention relates to plastic produce bags having no bottom seam and to methods for making the bags. The lack of a bottom seam provides for increased resistance to rupturing. Further, these bags are folded in thirds across their side seams to permit dispensing from a compact roll dispenser.

BACKGROUND OF THE INVENTION

Various designs have been developed for plastic produce bags as well as for methods for making and dispensing the bags.

U.S. Pat. No. 5,611,627 issued to Belias et al. is directed to an easy open thermoplastic bag. The bag is manufactured from a flattened tube of thermoplastic material with transverse heat seals. The transverse heat seals along with the sinusoidally oscillating paths form the tube into two halves or bags. The result of the transverse heat-seals and the cutting paths, is that two bags are formed with seamless bottoms. The sinusoidal cuts in the front and back portions of the tube respectively give rise to a mouth or opening for the bags with tabs that allow for the bags to be more easily opened.

U.S. Pat. No. 4,164,170 issued to Nordin, discloses a method of making bags. The Patent describes the manufacturing of a string of bags from a hose-like blank. Since a hose-like blank is used, the bottoms of the resultant bags are continuous in nature and the sides of a bag are formed by welds with separation lines in order to separate one set of bags from another. The hose-like blank is cut into two substantially equal parts along a center line while the cutting lines are offset to form the handles of the finished bag.

U.S. Pat. No. 4,811,418, issued to Reifenhauser is directed to a method for the manufacture of plastic bags with welded side seams. The patent describes the production of two bags side-by-side in parallel from tubular film that is fed in a first direction. The tubular film is cut in a sinusoidal configuration in the center of the film, thus forming two semitubes to form two side seam bags with welded side seams and handle opening portions.

U.S. Pat. No. 2,444,685 issued to Waters is directed to the multiple fabrication method and apparatus for forming liquid-type envelope bags. A supply roll of material with defined edges is passed through feed rolls and around a former plate in order to bring the edges together along a line with a defined space between them. The edges ultimately form the opening of the envelope after having been cut by a cutter into separate envelopes. A pair of transverse welds are formed in the process and the paired envelopes are cut by means of cross-cut knife.

U.S. Pat. No. 5,967,663 issued to Vaquero et al. is directed to a thermoplastic bag structure. The thermoplastic tube is cut into two portions by means of cutting instruments that form sinusoidal paths and hence sinusoidal cuts. Transverse heat seals and transverse perforations separate the tube into pairs of bags such that the folded bottom edge does not require heat sealing and the openings of the resultant bags have "tabs" so that they may be more easily opened.

U.S. Pat. No. 6,488,222, issued to West et al., describes A folded gusseted plastic bag has a first side gusset formed by first, second, and third longitudinal folds, a second side gusset formed by fourth, fifth, and sixth longitudinal folds, a seventh longitudinal fold being on a side of the bag containing the first, second, and third folds and forming a first folded bag flap, and an eighth longitudinal fold which is on a side of the bag containing the fourth, fifth, and sixth folds, the eighth fold forming a second folded bag flap. The folded gusseted bag also is folded into a total of at least eight contiguous plies. A roll of the folded, gusseted bags includes a continuous web of the folded, flattened bags joined along perforated severance lines. Preferably the perforated severance lines further comprise a centrally-located slit. The dispensing system utilizes the roll of folded-gusseted bags in combination with a dispenser comprising: (i) a support member for attachment to a support surface; (ii) a pair of guide channels carried by the support member for rotatably supporting the roll of plastic bags for rotation of the roll on the core; (iii) a tongue spaced apart from and carried by said support member in a predetermined position corresponding to the predetermined position of the slit in the tear line.

U.S. Pat. No. 6,379,292, issued to Simhaee, illustrates a continuous web of bags formed of a plurality of layers to be separated along a line of perforations that extends through all of the layers transverse of the web, in which at least one of the outermost layers is detached from the web at the separation line. Apparatus accomplishes this detachment in a moving web by engaging the outermost layer outer surface and exerting a force in a manner to produce the detachment from the separation line. Both the outermost upper and lower web layers can be detached at the separation line.

U.S. Pat. No. 5,967,663, issued to Vaquero et al., discloses a thermoplastic bag structure and method for making and packaging thermoplastic bags such that their tops are easily identified and the bags are easily opened. The method for producing these bags begins with cutting a flattened thermoplastic tube into two portions. At least one of the two portions is then collapsed to form a sheet of material having a pair of thermoplastic layers, a straight folded bottom edge and a pair of top edges, at least one of which has a skewed-cut. Bag side structures are formed in the sheet of material at about bag-width distances apart. The bags are then folded a predetermined number of times, in a direction transverse to the bag side structures, so that the skewed-cut top edge(s) of each of the bags remains exposed.

While other variations exist, the above-described designs for plastic produce bags are typical of those encountered in the prior art. It is an objective of the present invention to provide a produce bag without a bottom seam for additional strength in the bag bottom. It is a further objective to provide a produce bag that provides means to easily identify and open the bag. It is a still further objective of the invention to provide the above-described capabilities in a produce bag that can be easily dispensed from a roll using a compact and inexpensive dispenser. It is a further objective to provide bags that can be formed into compact rolls on cores or without cores. It is yet a further objective to provide a means to manufacture such produce bags using economical and reliable high-speed methods. While some of the objectives of the present invention are disclosed in the prior art, none of the inventions found include all of the requirements identified.

SUMMARY OF THE INVENTION

The present invention addresses all of the deficiencies of side-seamed plastic produce bag inventions and satisfies all of the objectives described above.

(1) A trifold side-seamed plastic produce bag providing the desired features may be constructed from the following components. A front wall is provided. The front wall has a top edge, a bottom edge, a first side edge, a second side edge and a first predetermined height. A back wall is provided. The back wall has an upper edge, a lower edge, a first side edge, a second side edge and a second predetermined height greater than the first predetermined height. The front wall and the back wall are formed from a single piece of plastic film such that the bottom edge of the front wall is joined seamlessly with the lower edge of the back wall.

The first side edge of the front wall is attached to the first side edge of the back wall at a first side seam. The second side edge of the front wall is attached to the second side edge of the back wall at a second side seam. A perforation is provided. The perforation is spaced from the second side seam and extends from the upper edge of the back wall to the lower edge of the back wall. The perforation joins the bag to a subsequent bag. First and second fold lines are provided. The first and second fold lines are parallel to the upper and lower edges and spaced from the upper and lower edges, respectively, by approximately one third of the second predetermined height. When separated from the subsequent bag, the bag will have a back wall of greater height than the front wall, thereby providing a means for locating an opening of the bag.

(2) A method of making trifold side-seamed plastic produce bags, comprises the steps of: extruding a continuous tube of plastic film and flattening the tube. The tube has an upper surface, a lower surface, first and second side edges. Slitting the upper surface to remove a strip of plastic material to form a cut. The cut has a first side and a second side. The first and second sides are parallel to the first and second side edges of the tube. Removing the strip. Forming a perforation perpendicular to the first and second side edges across an entire width of the tube. Sealing the tube at a first side seam. The first side seam is spaced from and parallel to the perforation. Sealing the tube at a second side seam. The second side seam is spaced from and parallel to the first side seam. Cutting the lower surface at a point below and between the first and second sides of the slit in the upper surface to form two facing bag streams, each of said bag streams having a first predetermined width. Folding each of the bag streams to approximately one third of the first predetermined width.

(3) In a variant of the method of making trifold side-seamed plastic produce bags, the method includes the further step of corona treating at least one of the upper surface and the lower surface of the flattened tube prior to slitting the upper surface to remove the strip of plastic material.

(4) In a further variant of the method includes the further step of printing advertising or informational material on at least one of the corona treated surfaces of the flattened tube.

(5) In still a further variant of the method includes the further step of rolling each of the bag streams to form a bag roll.

(6) In yet a further variant of the method includes the further step of rolling each of the bag streams about a cylindrical core to form a bag roll.

(7) In another variant of the method, each of the bag streams is folded in a Z-fold configuration.

(8) In still another variant of the method, each of the bag streams is folded in a Z-fold configuration.

(9) In another variant of the method of making trifold side-seamed plastic produce bags, the method includes the steps of: Extruding a continuous tube of plastic film and flattening the tube. The tube has an upper surface, a lower surface, first and second side edges. Winding the flattened tube onto a core. Moving the core to a cutting machine. The cutting machine includes a slitter. Feeding the tube from the core into the cutting machine. Slitting the upper surface to remove a strip of plastic material to for a cut. The cut has a first side and a second side. The first and second sides are parallel to the first and second side edges of the tube. Removing the strip. Forming a perforation perpendicular to the first and second side edges across an entire width of the tube. Sealing the tube at a first side seam. The first side seam is spaced from and parallel to the perforation. Sealing the tube at a second side seam. The second side seam is spaced from and parallel to the first side seam. Cutting the lower surface at a point below and between the first and second sides of the slit in the upper surface to form two facing bag streams, each of said bag streams having a first predetermined width. Folding each of the bag streams to approximately one third of the first predetermined width.

(10) In a further variant of the method of making trifold side-seamed plastic produce bags, the method includes the further step of corona treating at least one of the upper surface and the lower surface of the flattened tube prior to slitting the upper surface to remove the strip of plastic material.

(11) In still a further variant of the method includes the further step of printing advertising or informational material on at least one of the corona treated surfaces of the flattened tube.

(12) In yet a further variant of the method includes the further step of rolling each of said bag streams to form a bag roll.

(13) In another variant of the method includes the further step of rolling each of said bag streams about a cylindrical core to form a bag roll.

(14) In still another variant of the method, each of said bag streams is folded in a Z-fold configuration.

(15) In yet another variant of the method, each of said bag streams is folded in a C-fold configuration.

(16) In a further variant of the method of making trifold side-seamed plastic produce bags, the method includes the steps of: Extruding a continuous tube of plastic film and flattening the tube. The tube has an upper surface, a lower surface, first and second side edges. Corona treating at least one of the upper surface and the lower surface of the flattened tube. Slitting the upper surface to remove a strip of plastic material to form a cut. The cut has a first side and a second side. The first and second sides are parallel to the first and second side edges of the tube. Removing the strip. Printing either advertising or informational material on at least one of the corona treated surfaces of the flattened tube. Forming a perforation perpendicular to the first and second side edges across an entire width of the tube. Sealing the tube at a first side seam spaced from and parallel to the perforation. Sealing the tube at a second side seam. The second side seam is spaced from and parallel to the first side seam. Winding the tube onto a core for later cutting of the lower surface at a point below and between the first and second sides of the cut in the upper surface to form two facing bag streams, each of said bag streams having a first predetermined width. Folding each of said bag streams to approximately one third of said first predetermined width.

(17) In still a further variant of the method of making trifold side-seamed plastic produce bags, the method includes the step of rolling each of said bag streams to form a bag roll.

(18) In another variant of the method of making trifold side-seamed plastic produce bags, the method includes the step of rolling each of said bag streams about a cylindrical core to form a bag roll.

(19) In still another variant of the method, each of said bag streams is folded in a Z-fold configuration.

(20) In yet another variant of the method, each of said bag streams is folded in a C-fold configuration.

(21) In still another variant of the method of making trifold side-seamed plastic produce bags, the method includes the steps of: Extruding a continuous tube of plastic film and flattening the tube. The tube has an upper surface, a lower surface, first and second side edges. Corona treating at least one of the upper surface and the lower surface of the flattened tube. Printing either advertising or informational material on at least one of the corona treated surfaces of the flattened tube. Slitting the upper surface to remove a strip of plastic material to form a cut. The cut has a first side and a second side. The first and second sides are parallel to the first and second side edges of the tube. Removing the strip. Forming a perforation perpendicular to the first and second side edges across an entire width of the tube. Sealing the tube at a first side seam spaced from and parallel to the perforation. Sealing the tube at a second side seam. Folding each of said bag streams to approximately one third of said first predetermined width. The second side seam is spaced from and parallel to the first side seam. Winding the tube onto a core for later cutting of the lower surface at a point below and between the first and second sides of the cut in the upper surface to form two facing bag streams, each of said bag streams having a first predetermined width. Folding each of said bag streams to approximately one third of said first predetermined width.

(22) In a further variant of the method, the method includes the further step of rolling each of the bag streams to form a bag roll.

(23) In still a further variant of the method, the method includes the further step of rolling each of the bag streams about a cylindrical core to form a bag roll.

(24) In still another variant of the method, each of said bag streams is folded in a Z-fold configuration.

(25) In yet another variant of the method, each of said bag streams is folded in a C-fold configuration.

(26) An apparatus for making tri-fold side-seamed plastic produce bags includes the following components. A supply of thermoplastic resin is provided. An extruder is provided. The extruder is capable of extruding a continuous tube of thermoplastic film. A tubing flattener is provided. The flattener is capable of flattening the tube. The tube has an upper surface, a lower surface, first and second side edges. A cutting machine is provided. The cutting machine is capable of slitting the upper surface to remove a strip of plastic material to form a cut. The cut has a first side and a second side. The first and second sides are parallel to the first and second side edges of the tube. A perforator is provided. The perforator is capable of forming a perforation perpendicular to the first and second side edges across an entire width of the tube. A sealer is provided. The sealer is capable of sealing the tube at a first side seam spaced from and parallel to the perforation and at a second side seam spaced from and parallel to the first side seam. A slitter is provided. The is slitter capable of cutting the lower surface at a point below and between the first and second sides of the cut in the upper surface to form two facing bag streams. Each of the bag streams has a first predetermined width. A folder is provided. The folder is capable of folding each of the bag streams to approximately one third of the first predetermined width.

(27) In another variant of the apparatus, a corona treater is provided. The corona treater is capable of corona treating at least one upper and lower surface of the tube prior to folding.

(28) In still another variant, a printer is provided. The printer capable of printing advertising or informational material on at least one of the corona treated surfaces of the flattened tube.

(29) In yet another variant, a bag rolling device is provided. The bag rolling device is capable of rolling each of the bag streams to form a bag roll.

(30) In a further variant, a supply of cores is provided. Each of the bag streams is wound around one of the cores to form the bag rolls.

(31) In still a further variant, the folder is capable of folding each of the bag streams in a Z-fold configuration.

(32) In yet a further variant, the folder is capable of folding each of the bag streams in a C-fold configuration.

(1) A trifold side-seamed plastic produce bag providing the desired features may be constructed from the following components. A front wall is provided. The front wall has a top edge, a bottom edge, a first side edge, a second side edge and a first predetermined height. A back wall is provided. The back wall has an upper edge, a lower edge, a first side edge, a second side edge and the first predetermined height. The front wall and the back wall are formed from a single piece of plastic film such that the bottom edge of the front wall is joined seamlessly with the lower edge of the back wall.

The first side edge of the front wall is attached to the first side edge of the back wall at a first side seam. The second side edge of the front wall is attached to the second side edge of the back wall at a second side seam. A perforation is provided. The perforation is spaced from the second side seam and extends from the upper edges of the front and the back walls to the lower edge. The perforation joins the bag to a subsequent bag. First and second fold lines are provided. The first and second fold lines are parallel to the upper and lower edges and spaced from the upper and lower edges, respectively, by approximately one third of the first predetermined height. When separated from the subsequent bag, the bag will have a front wall and a back wall of substantially identical height.

(2) A method of making trifold side-seamed plastic produce bags, comprises the steps of: extruding a continuous tube of plastic film and flattening the tube. The tube has an upper surface, a lower surface, first and second side edges. Forming a perforation perpendicular to the first and second side edges across an entire width of the tube. Sealing the tube at a first side seam. The first side seam is spaced from and parallel to the perforation. Sealing the tube at a second side seam. The second side seam is spaced from and parallel to the first side seam. Cutting the upper surface and the lower surface to form two facing bag streams, each of said bag streams having a first predetermined width. Folding each of the bag streams to approximately one third of the first predetermined width.

(3) In a variant of the method of making trifold side-seamed plastic produce bags, the method includes the further step of corona treating at least one of the upper surface and the lower surface of the flattened tube.

(4) In a further variant of the method includes the further step of printing advertising or informational material on at least one of the corona treated surfaces of the flattened tube.

(5) In still a further variant of the method includes the further step of rolling each of the bag streams to form a bag roll.

(6) In yet a further variant of the method includes the further step of rolling each of the bag streams about a cylindrical core to form a bag roll.

(7) In another variant of the method, each of the bag streams is folded in a Z-fold configuration.

(8) In still another variant of the method, each of the bag streams is folded in a C-fold configuration.

(9) In a further variant of the method of making trifold side-seamed plastic produce bags, the method includes the steps of: Extruding a continuous tube of plastic film and flattening the tube. The tube has an upper surface, a lower surface, first and second side edges. Corona treating at least one of the upper surface and the lower surface of the flattened tube. Printing either advertising or informational material on at least one of the corona treated surfaces of the flattened tube. Forming a perforation perpendicular to the first and second side edges across an entire width of the tube. Sealing the tube at a first side seam spaced from and parallel to the perforation. Sealing the tube at a second side seam. The second side seam is spaced from and parallel to the first side seam. Winding the tube onto a core for later cutting of the upper surface and the lower surface to form two facing bag streams, each of said bag streams having a first predetermined width. Folding each of said bag streams to approximately one third of said first predetermined width.

(10) In still a further variant of the method of making trifold side-seamed plastic produce bags, the method includes the step of rolling each of said bag streams to form a bag roll.

(11) In another variant of the method of making trifold side-seamed plastic produce bags, the method includes the step of rolling each of said bag streams about a cylindrical core to form a bag roll.

(12) In still another variant of the method, each of said bag streams is folded in a Z-fold configuration.

(13) In yet another variant of the method, each of said bag streams is folded in a C-fold configuration.

(14) An apparatus for making tri-fold side-seamed plastic produce bags includes the following components. A supply of thermoplastic resin is provided. An extruder is provided. The extruder is capable of extruding a continuous tube of thermoplastic film. A tubing flattener is provided. The flattener is capable of flattening the tube. The tube has an upper surface, a lower surface, first and second side edges. A *perforator* is provided. The *perforator* is capable of forming a perforation perpendicular to the first and second side edges across an entire width of the tube. A sealer is provided. The sealer is capable of sealing the tube at a first side seam spaced from and parallel to the perforation and at a second side seam spaced from and parallel to the first side seam. A slitter is provided. The slitter is capable of cutting the upper surface and the lower surface to form two facing bag streams. Each of the bag streams has a first predetermined width. A folder is provided. The folder is capable of folding each of the bag streams to approximately one third of the first predetermined width.

(15) In another variant of the apparatus, a corona treater is provided. The corona treater is capable of corona treating at least one upper and lower surface of the tube prior to folding.

(16) In still another variant, a printer is provided. The printer capable of printing advertising or informational material on at least one of the corona treated surfaces of the flattened tube.

(17) In yet another variant, a bag rolling device is provided. The bag rolling device is capable of rolling each of the bag streams to form a bag roll.

(18) In a further variant, a supply of cores is provided. Each of the bag streams is wound around one of the cores to form the bag rolls.

(19) In still a further variant, the folder is capable of folding each of the bag streams in a Z-fold configuration.

(20) In yet a further variant, the folder is capable of folding each of the bag streams in a C-fold configuration.

DESCRIPTION OF THE DRAWINGS

FIG. 1 is a perspective view of the preferred embodiment of the invention, a trifold side seamed produce bag as formed in FIG. 1A;

FIG. 1A is a perspective view of the FIG. 1 embodiment of the invention as the bags are formed, illustrating two facing streams of side seamed plastic produce bags attached with perforations;

FIG. 17 is a perspective view of the preferred embodiment of the invention, a trifold side seamed produce bag as formed in FIG. 17A;

FIG. 17A is a perspective view of the FIG. 17 embodiment of the invention as the bags are formed, illustrating two facing streams of side seamed plastic produce bags attached with perforations;

FIG. 17B is a perspective view of the FIG. 17 embodiment after folding in thirds;

FIG. 19 is a perspective view of the FIG. 18 embodiment further illustrating corona treatment and printing of the tube prior to slitting;

FIG. 20 is a perspective view of a coreless roll of the FIG. 17 bags;

FIG. 21 is a perspective view of a cored roll of the FIG. 17 bags;

FIG. 22 is a perspective view of the FIG. 17 bag folded into a Z-fold configuration;

FIG. 23 is a perspective view of the FIG. 17 bag folded into a C-fold configuration;

DETAILED DESCRIPTION OF THE PREFERRED EMBODIMENT (1) FIGS. 1, 1A and 1B illustrate a trifold side-seamed plastic produce bag 10 providing the desired features that may be constructed from the following components. A front wall 15 is provided. The front wall 15 has a top edge 20, a bottom edge 25, a first side edge 30, a second side edge 35 and a first predetermined height 40. A back wall 45 is provided. The back wall 45 has an upper edge 50, a lower edge 55, a first side edge 60, a second side edge 65 and a second predetermined height 70 greater than the first predetermined height 40. The front wall 15 and the back wall 45 are formed from a single piece of plastic film 75 such that the bottom edge 25 of the front wall 15 is joined seamlessly with the lower edge 55 of the back wall 45.

The first side edge 30 of the front wall 15 is attached to the first side edge 60 of the back wall 45 at a first side seam 80. The second side edge 35 of the front wall 15 is attached to the second side edge 65 of the back wall 45 at a second side seam 85. A perforation 90 is provided. The perforation 95 is spaced from the second side seam 85 and extends from the upper edge 50 of the back wall 45 to the lower edge 55 of the back wall 45. The perforation 90 joins the bag 10 to a subsequent bag 10*a*. First 17 and second 19 fold lines are provided. The first 17 and second 19 fold lines are parallel to the upper 50 and lower 55 edges and spaced from the upper 50 and lower 55 edges, respectively, by approximately one third of the second predetermined height 70. As illustrated in FIG. 1A, when separated from the subsequent bag 10*a*, the bag 10 will have a back wall 45 of greater height than the front wall 15, thereby providing a means for locating an opening 100 of the bag 10.

Figure 2:
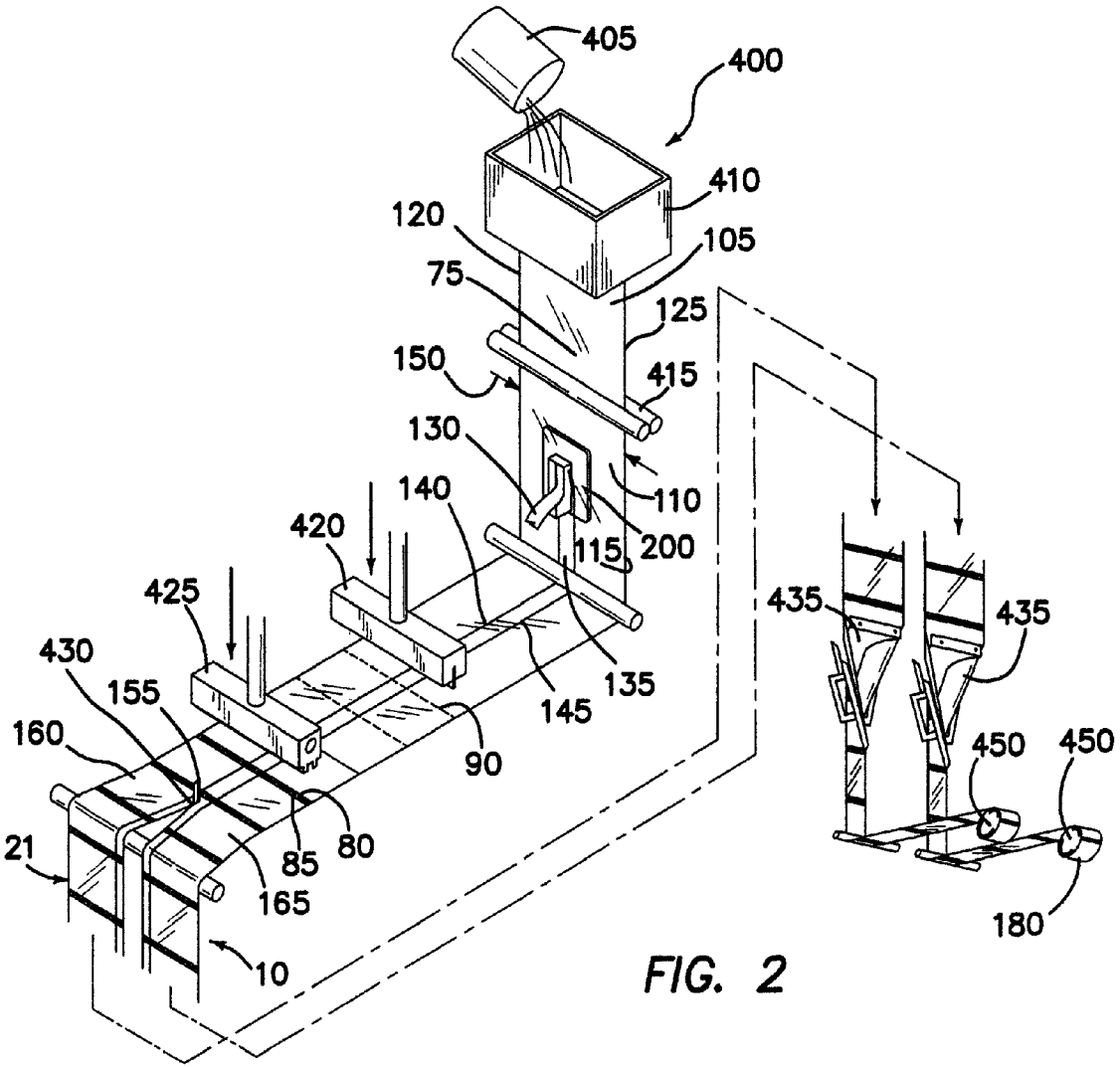
FIG. 2 is a perspective view of a first method of making the invention illustrating the flattening and slitting of the tube, perforating the tube, sealing the bag side edges, cutting the two facing bag streams apart, folding them in thirds and winding them on rolls.
Figures 3, 4, 5:
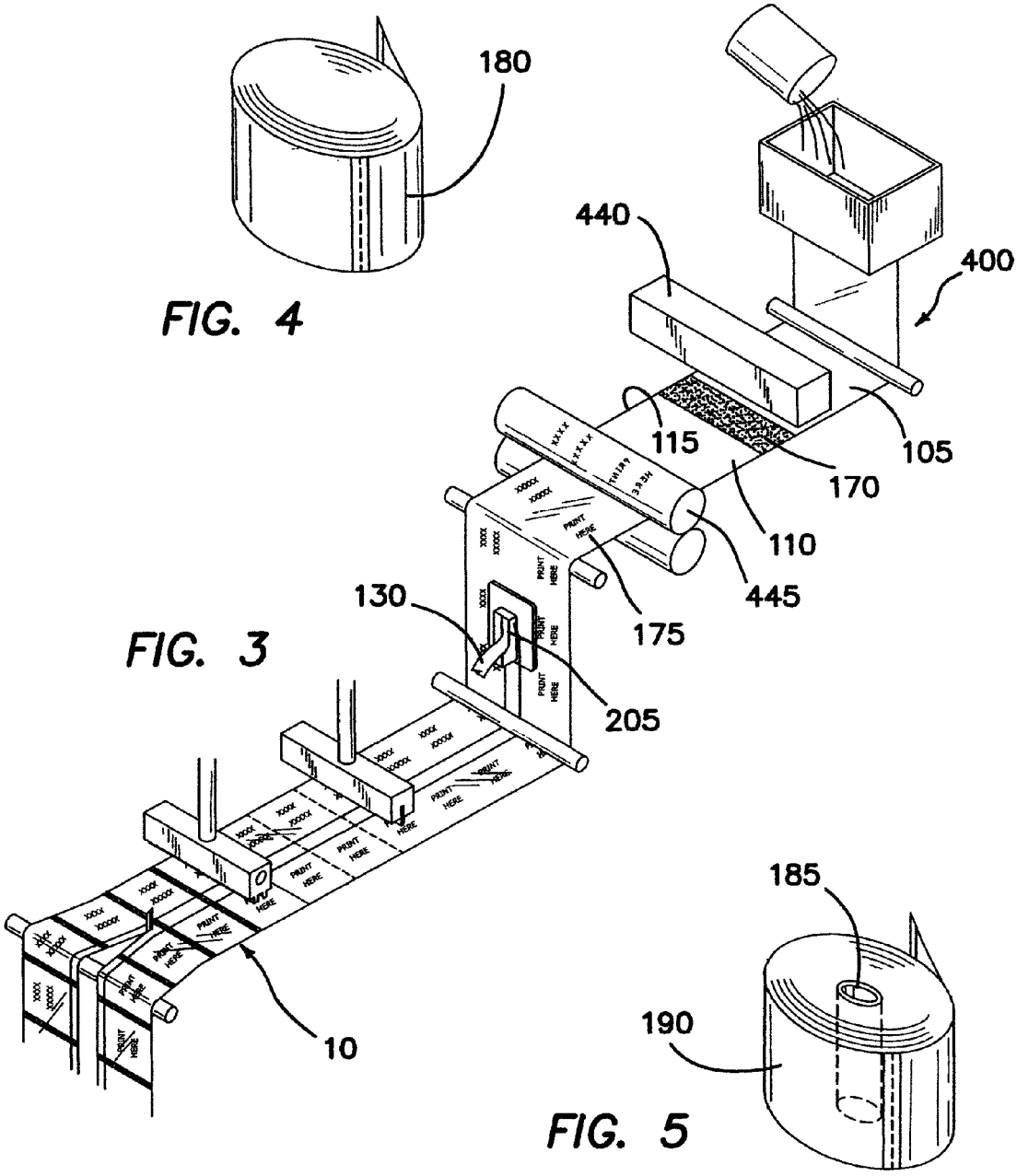
FIG. 3 is a perspective view of the FIG. 2 embodiment further illustrating corona treatment and printing of the tube prior to slitting.
FIG. 4 is a perspective view of a coreless roll of the FIG. 1 bags.
FIG. 5 is a perspective view of a cored roll of the FIG. 1 bags.

(2) A method of making trifold side-seamed plastic produce bags 10, as illustrated in FIGS. 2 and 3, comprises the steps of: extruding a continuous tube 105 of thermoplastic film 75 and flattening the tube 105. The tube 105 has an upper surface 110, a lower surface 115, first 120 and second 125 side edges. Slitting the upper surface 110 to remove a strip of plastic material 130 to form a cut 135. The cut 135 has a first side 140 and a second side 145. The first 140 and second 145 sides are parallel to the first 120 and second 125 side edges of the tube 105. Removing the strip 130. Forming a perforation 90 perpendicular to the first 120 and second 125 side edges across an entire width 150 of the tube 105. Sealing the tube 105 at a first side seam 80. The first side seam 80 is spaced from and parallel to the perforation 90. Sealing the tube 105 at a second side seam 85. The second side seam 85 is spaced from and parallel to the first side seam 80. Cutting the lower surface 115 at a point 155 below and between the first 140 and second 145 sides of the slit 135 in the upper surface 110 to form two facing bag streams 160, 165, each of said bag streams 160, 165 having a first predetermined width 21. Folding each of the bag streams 160, 165 to approximately one third of the first predetermined width 21.

(3) In a variant of the method of making trifold side-seamed plastic produce bags 10, as illustrated in FIG. 4, the method includes the further step of corona treating 170 at least one of the upper surface 110 and the lower 115 surface of the flattened tube 105 prior to slitting the upper surface 110 to remove the strip of plastic material 130.

(4) In a further variant of the method, also illustrated in FIG. 3, the method includes the further step of printing advertising or informational material 175 on at least one of the corona treated 170 surfaces 110, 115 of the flattened tube 105.

(5) In still a further variant of the method, as illustrated in FIGS. 2 and 4, the method includes the further step of rolling each of the bag streams 160, 165 to form a bag roll 180.

(6) In yet a further variant of the method, as illustrated in FIG. 5, the method includes the further step of rolling each of the bag streams 160, 165 about a cylindrical core 185 to form a bag roll 190.

Figure 1B:
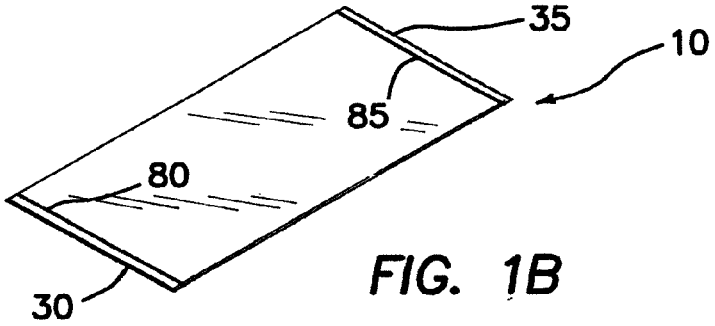
FIG. 1B is a perspective view of the FIG. 1 embodiment after folding in thirds.
Figure 6:
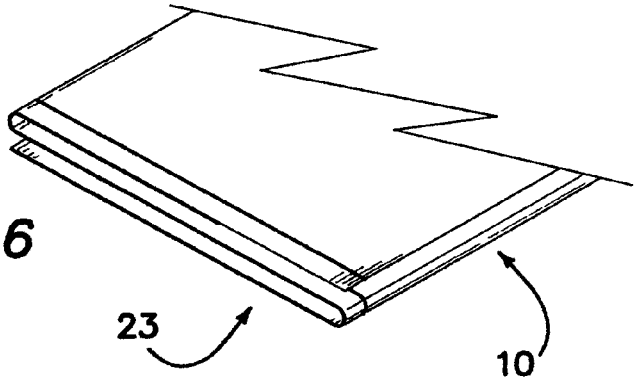
FIG. 6 is a perspective view of the FIG. 1 bag folded into a Z-fold configuration.

(7) In another variant of the method, as illustrated in FIG. 6, each of the bag streams 160, 165 is folded in a Z-fold configuration 23.

Figure 7:
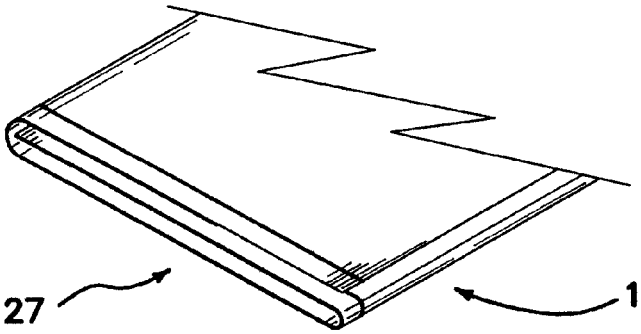
FIG. 7 is a perspective view of the FIG. 1 bag folded into a C-fold configuration.

(8) In still another variant of the method, as illustrated in FIG. 7, each of the bag streams is folded in a C-fold configuration 27.

Figure 8:
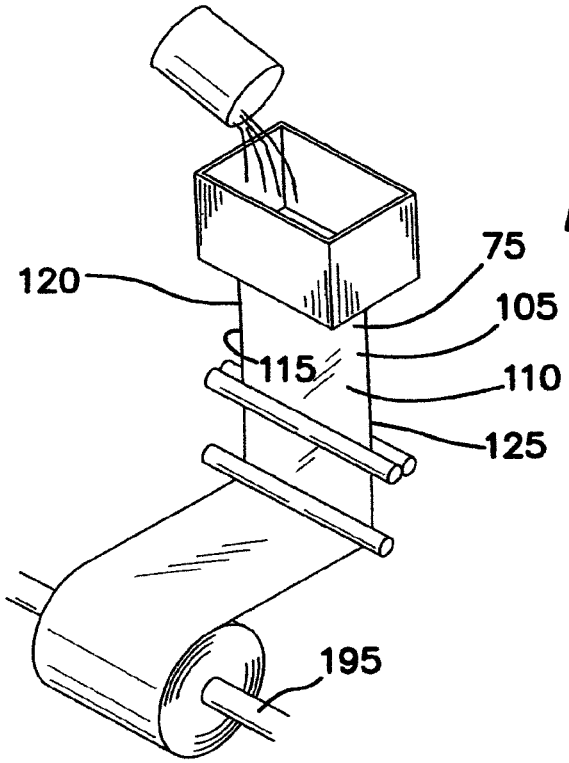
FIG. 8 is a perspective view of a process for forming a flattened plastic tube and rolling same onto a core for later processing.
Figure 9:
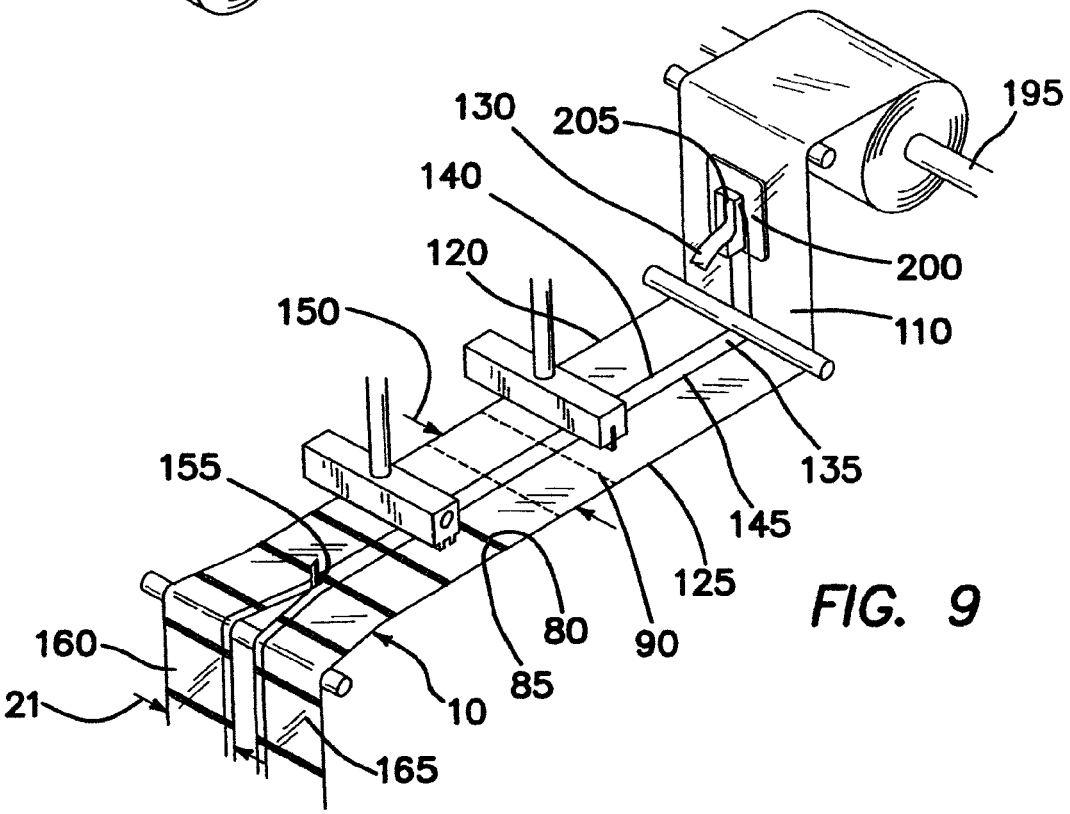
FIG. 9 is a perspective view of a second portion of the FIG. 8 process in which the printed tube is slit, perforated, sealed and cut into two facing bag streams.

(9) In another variant of the method of making trifold side-seamed plastic produce bags 10, as illustrated in FIGS. 8 and 9, the method includes the steps of: Extruding a continuous tube 105 of plastic film 75 and flattening the tube 105. The tube 105 has an upper surface 110, a lower surface 115, first 120 and second 125 side edges. Winding the flattened tube 105 onto a core 195. Moving the core 195 to a cutting machine 200. The cutting machine 200 includes a slitter 205. Feeding the tube 105 from the core 195 into the cutting machine 200. Slitting the upper surface 110 to remove a strip of plastic material 130 and form a cut 135. The cut 135 has a first side 140 and a second side 145. The first 140 and second 145 sides are parallel to the first 120 and second 125 side edges of the tube 105. Removing the strip 130. Forming a perforation 90 perpendicular to the first 120 and second 125 side edges across an entire width 150 of the tube 105. Sealing the tube 105 at a first side seam 80. The first side seam 80 is spaced from and parallel to the perforation 90. Sealing the tube 105 at a second side seam 85. The second side seam 85 is spaced from and parallel to the first side seam 80. Cutting the lower surface 115 at a point 155 below and between the first 140 and second 145 sides of the cut 135 in the upper surface 110 to form two facing bag streams 160, 165, each of said bag streams 160, 165 having a first predetermined width 21. Folding each of the bag streams 160, 165 to approximately one third of the first predetermined width 21.

(10) In a further variant of the method of making trifold side-seamed plastic produce bags 10, also illustrated in FIG. 7, the method includes the further step of corona treating 170 at least one of the upper surface 110 and the lower surface 115 of the flattened tube 105 prior to slitting the upper surface 110 to remove the strip of plastic material 130.

(11) In still a further variant of the method, as illustrated in FIG. 3, the method includes the further step of printing advertising or informational material 175 on at least one of the corona treated 170 surfaces 110, 115 of the flattened tube 105.

(12) In still a further variant of the method, as illustrated in FIG. 4, the method includes the further step of rolling each of the bag streams 160, 165 to form a bag roll 180.

(13) In yet a further variant of the method, as illustrated in FIG. 5, the method includes the further step of rolling each of the bag streams 160, 165 about a cylindrical core 185 to form a bag roll 190.

(14) In another variant of the method, as illustrated in FIG. 6, each of the bag streams 160, 165 is folded in a Z-fold configuration 23.

(15) In still another variant of the method, as illustrated in FIG. 7, each of the bag streams is folded in a C-fold configuration 27.

Figure 10:
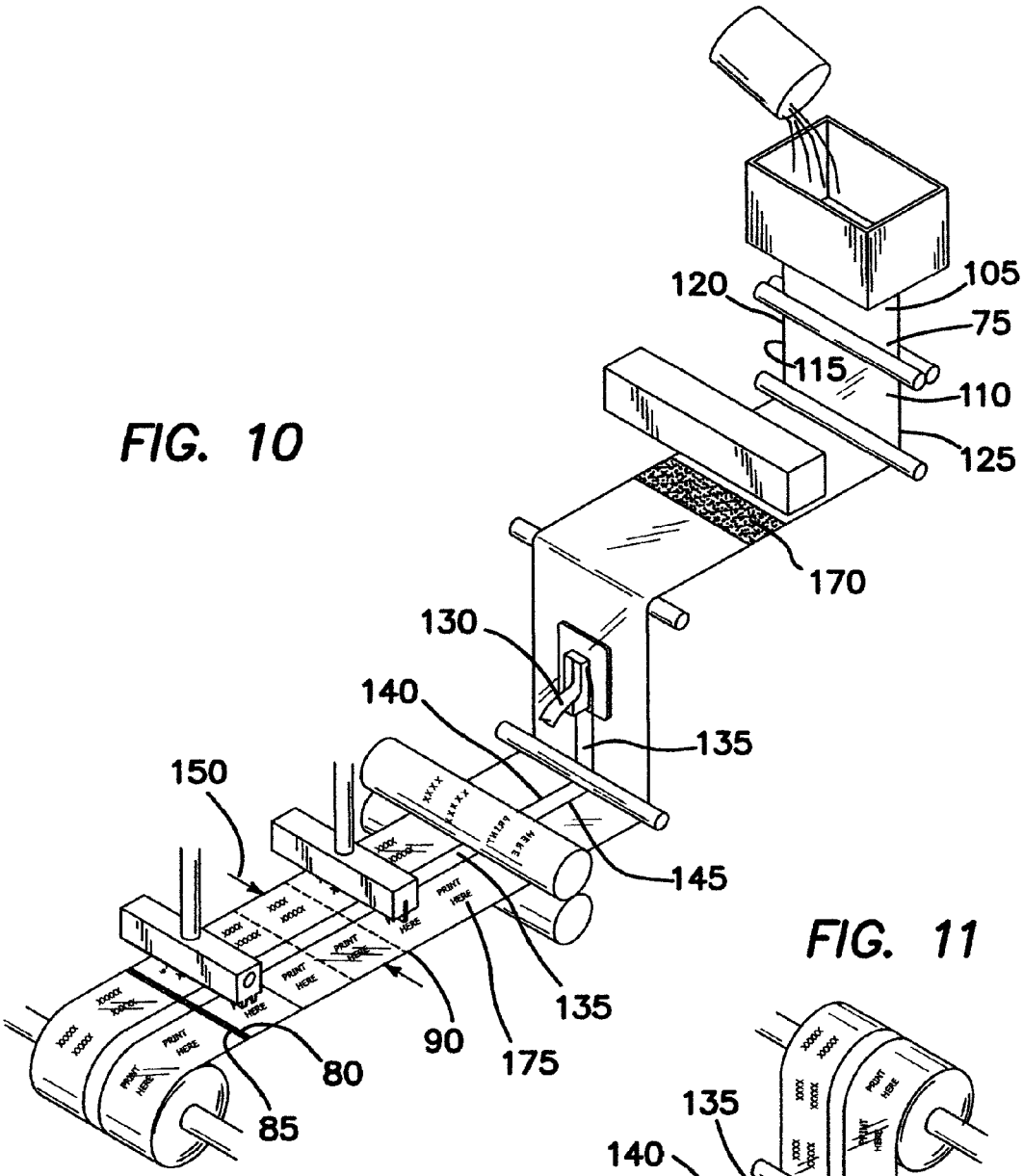
FIG. 10 is a perspective view of another method of making the FIG. 1 bags by corona treating, slitting, printing, perforating and sealing the tube and winding the tube onto a core for later separation into two facing bag streams.
Figure 11:
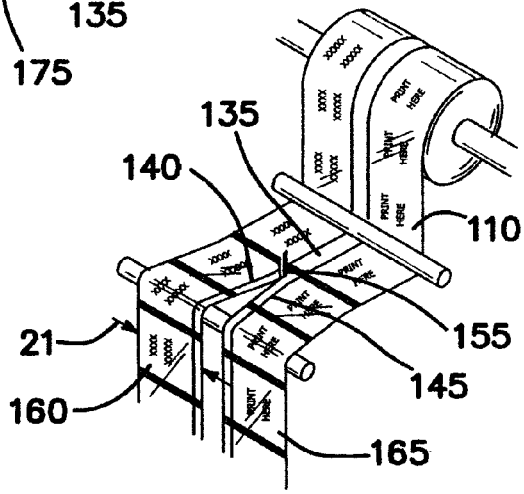
FIG. 11 is a perspective view of a second portion of the FIG. 10 process in which the printed tube, slit, perforated and sealed tube is cut into two facing bag streams.

(16) In yet another variant of the method of making trifold side-seamed plastic produce bags 10, as illustrated in FIGS. 10 and 11, the method includes the steps of: Extruding a continuous tube 105 of plastic film 75 and flattening the tube 105. The tube 105 has an upper surface 110, a lower surface 115, first 120 and second 125 side edges. Corona treating 170 at least one of the upper surface 110 and the lower surface 115 of the flattened tube 105. Slitting the upper surface 110 to remove a strip of plastic material 130 to form a cut 135. The cut 135 has a first side 140 and a second side 145. The first 140 and second 145 sides are parallel to the first 120 and second 125 side edges of the tube 105. Removing the strip 130. Printing either advertising or informational material 175 on at least one of the corona treated 170 surfaces 110, 115 of the flattened tube 105. Forming a perforation 90 perpendicular to the first 120 and second 125 side edges across an entire width 150 of the tube 105. Sealing the tube 105 at a first side seam 80 spaced from and parallel to the perforation 90. Sealing the tube 105 at a second side seam 85. The second side seam 85 is spaced from and parallel to the first side seam 80. Cutting the lower surface 115 at a point 155 below and between the first 140 and second 145 sides of the cut 135 in the upper surface 110 to form two facing bag streams 160, 165, each of said bag streams 160, 165 having a first predetermined width 21. Folding each of the bag streams 160, 165 to approximately one third of the first predetermined width 21, as illustrated in FIG. 2.

(17) In still a further variant of the method, as illustrated in FIG. 4, the method includes the further step of rolling each of the bag streams 160, 165 to form a bag roll 180.

(18) In yet a further variant of the method, as illustrated in FIG. 5, the method includes the further step of rolling each of the bag streams 160, 165 about a cylindrical core 185 to form a bag roll 190.

(19) In another variant of the method, as illustrated in FIG. 6, each of the bag streams 160, 165 is folded in a Z-fold configuration 23.

(20) In still another variant of the method, as illustrated in FIG. 7, each of the bag streams is folded in a C-fold configuration 27.

Figure 12:
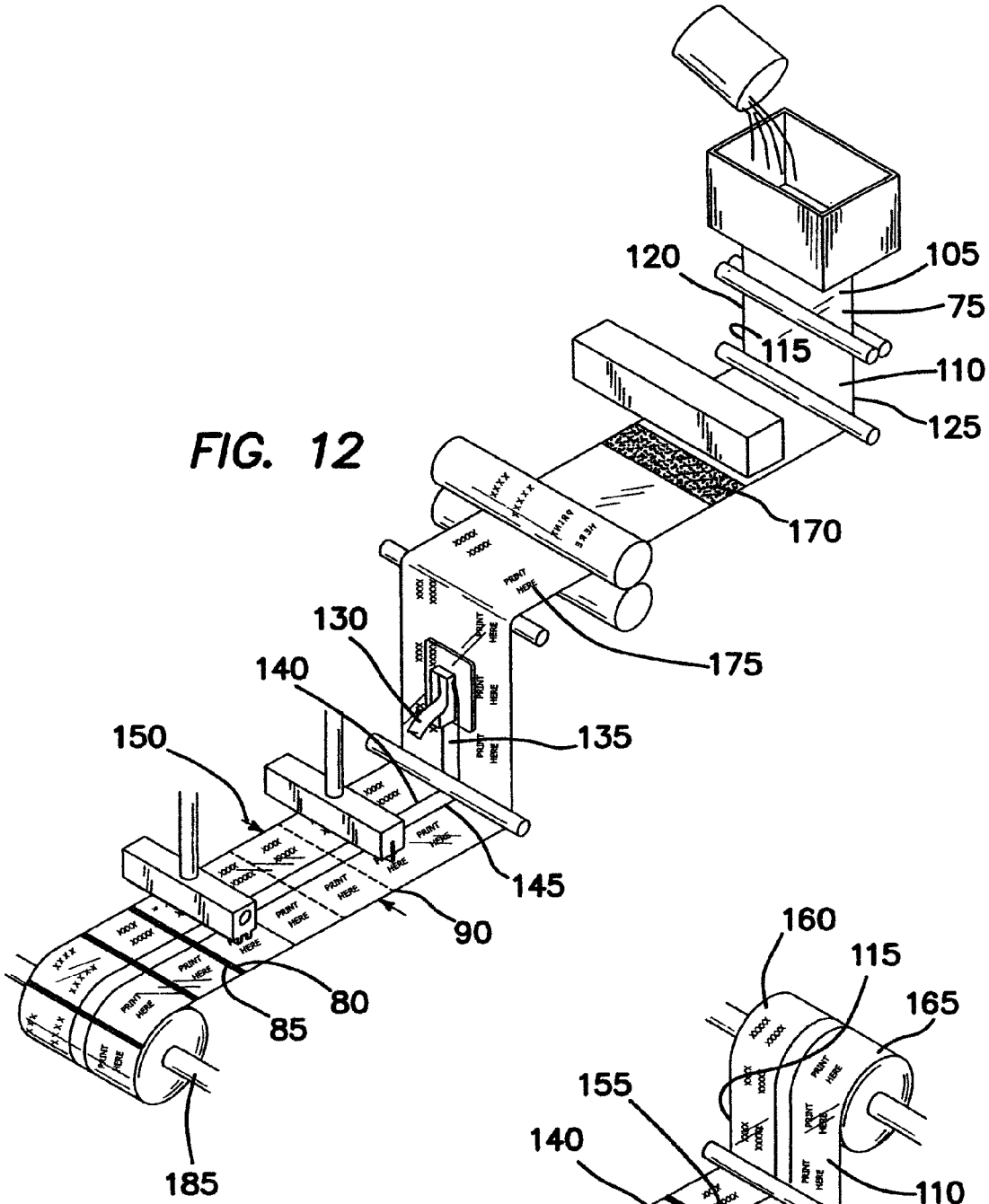
FIG. 12 is a perspective view of still another method of making the FIG. 1 bags by corona treating, printing, slitting, perforating and sealing the tube and winding the tube onto a core for later separation into two facing bag streams.
Figure 13:
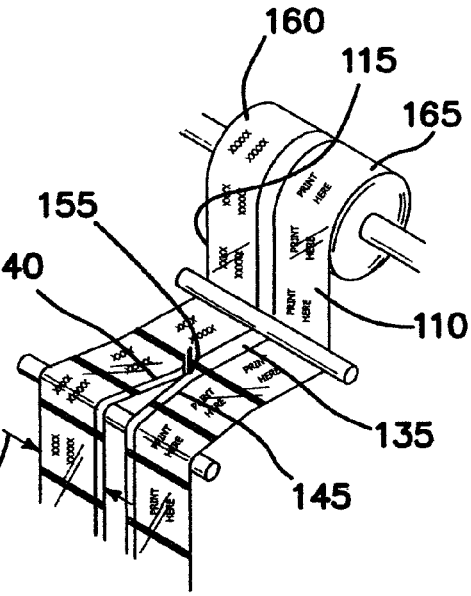
FIG. 13 is a perspective view of a second portion of the FIG. 12 process in which the printed tube, slit, perforated and sealed tube is cut into two facing bag streams.
Figure 14:
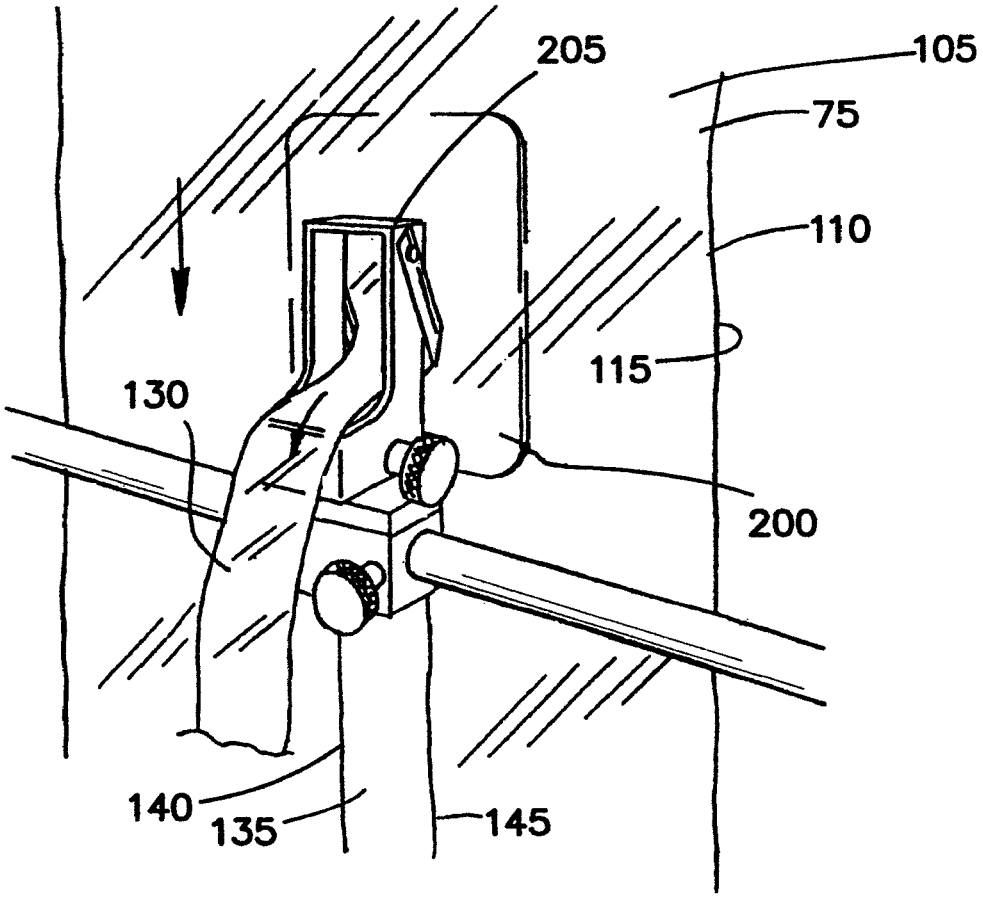
FIG. 14 is a detailed perspective view of a plastic film slitting mechanism removing a central strip from the tube.

(21) In still another variant of the method of making trifold side-seamed plastic produce bags 10, as illustrated in FIGS. 12 and 13, the method includes the steps of: Extruding a continuous tube 105 of plastic film 75 and flattening the tube 105. The tube 105 has an upper surface 110, a lower surface 115, first 120 and second 125 side edges. Corona treating 170 at least one of the upper surface 110 and the lower surface 115 of the flattened tube 105. Printing either advertising or informational material 175 on at least one of the corona treated 170 surfaces 110, 115 of the flattened tube 105. Slitting the upper surface 110 to remove a strip of plastic material 130 to form a cut 135. The cut 135 has a first side 140 and a second side 145. The first 140 and second 145 sides are parallel to the first 120 and second 125 side edges of the tube 105. Removing the strip 130. Forming a perforation 90 perpendicular to the first 120 and second 125 side edges across an entire width 150 of the tube 105. Sealing the tube 105 at a first side seam 80 spaced from and parallel to the perforation 90. Sealing the tube 105 at a second side seam 85. The second side seam 85 is spaced from and parallel to the first side seam 80. Winding the tube 105 onto a core 185 for later cutting of the lower surface 115 at a point 155 below and between the first 140 and second 145 sides of the cut 135 in the upper surface 110 to form two facing bag streams 160, 165, each of said bag streams 160, 165 having a first predetermined width 21. Folding each of the bag streams 160, 165 to approximately one third of the first predetermined width 21.

(22) In a further variant of the method, as illustrated in FIG. 4, the method includes the further step of rolling each of the bag streams 160, 165 to form a bag roll 180.

(23) In still a further variant of the method, as illustrated in FIG. 5, the method includes the further step of rolling each of the bag streams 160, 165 about a cylindrical core 185 to form a bag roll 190.

(24) In another variant of the method, as illustrated in FIG. 6, each of the bag streams 160, 165 is folded in a Z-fold configuration 23.

(25) In still another variant of the method, as illustrated in FIG. 7, each of the bag streams is folded in a C-fold configuration 27.

Figure 16:
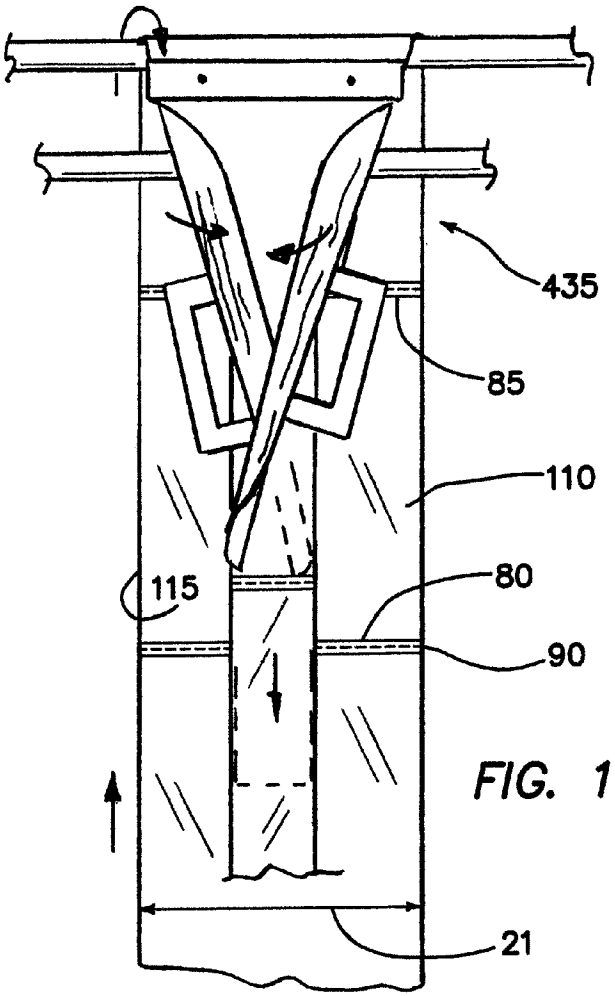
FIG. 16 is a detailed perspective view of the bag folding mechanism operating on a stream of trifold side seamed bags.
Figure 15:
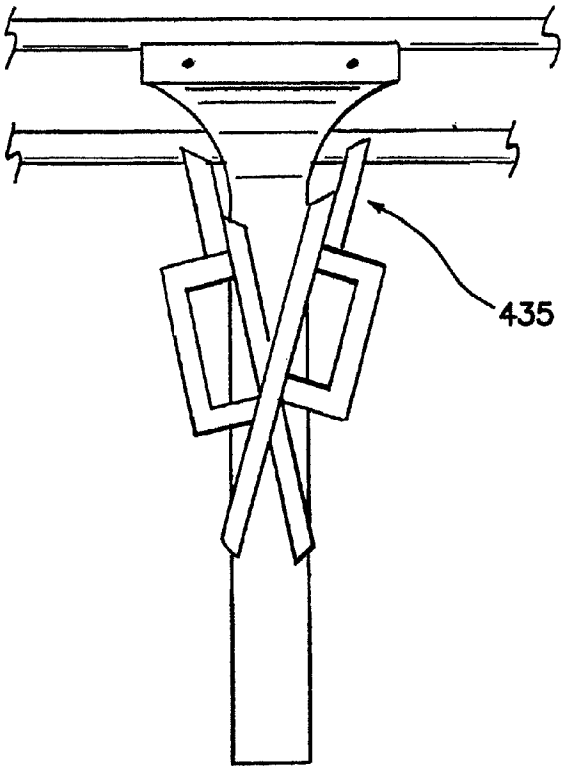
FIG. 15 is a detailed perspective view of a bag folding mechanism capable of folding a bag stream into thirds.

(26) As illustrated in FIG. 12, an apparatus 400 for making tri-fold side-seamed plastic produce bags 10 includes the following components. A supply of thermoplastic resin 405 is provided. An extruder 410 is provided. The extruder 410 is capable of extruding a continuous tube 105 of thermoplastic film 75. A tubing flattener 415 is provided. The flattener 415 is capable of flattening the tube 105. The tube 105 has an upper surface 110, a lower surface 115, first 120 and second 125 side edges. A cutting machine 200 is provided. The cutting machine 200, as illustrated in FIGS. 2 and 14, is capable of slitting the upper surface 110 to remove a strip of plastic material 130 to form a cut 135. The cut 135 has a first side 140 and a second side 145. The first 140 and second 145 sides are parallel to the first 120 and second 125 side edges of the tube 105. A perforator 420 is provided. The perforator 420 is capable of forming a perforation 90 perpendicular to the first 120 and second 125 side edges across an entire width 150 of the tube 105. A sealer 425 is provided. The sealer 425 is capable of sealing the tube 105 at a first side seam 80 spaced from and parallel to the perforation 90 and at a second side seam 85 spaced from and parallel to the first side seam 80. A slitter 430 is provided. The is slitter 430 is capable of cutting the lower surface 115 at a point 155 below and between the first 140 and second 145 sides of the cut 135 in the upper surface 110 to form two facing bag streams 160, 165. Each of the bag streams 160, 165 has a first predetermined width 21. A folder 435, as illustrated in FIGS. 2, 15 and 16, is provided. The folder 435 is capable of folding each of the bag streams 160, 165 to approximately one third of the first predetermined width 21.

(27) In another variant of the apparatus 400, as illustrated in FIG. 3, a corona treater 440 is provided. The corona treater 440 is capable of corona treating at least one of the upper 110 and lower 115 surface of the tube 105 prior to folding.

(28) In still another variant, a printer 445 is provided. The printer 445 is capable of printing advertising or informational material 175 on at least one of the corona treated surfaces 110, 115 of the flattened tube 105.

(29) In yet another variant, as illustrated in FIGS. 2 and 4, a bag rolling device 450 is provided. The bag rolling device 450 is capable of rolling each of the bag streams 160, 165 to form a bag roll 180.

(30) In a further variant, as illustrated in FIG. 5, a supply of cores 185 is provided. Each of the bag streams 160, 165 is wound around one of the cores 185 to form the bag rolls 190.

(31) In still a further variant, the folder 435 is capable of folding each of the bag streams 160, 165 in a Z-fold configuration 23, as illustrated in FIG. 6.

(32) In yet a further variant, the folder 435 is capable of folding each of the bag streams 160, 165 in a C-fold configuration 27, as illustrated in FIG. 7.

(1) FIGS. 17, 17A and 17B illustrate a trifold side-seamed plastic produce bag 10 providing the desired features that may be constructed from the following components. A front wall 15 is provided. The front wall 15 has a top edge 20, a bottom edge 25, a first side edge 30, a second side edge 35 and a first predetermined height 40. A back wall 45 is provided. The back wall 45 has an upper edge 50, a lower edge 55, a first side edge 60, a second side edge 65 and said first predetermined height 40. The front wall 15 and the back wall 45 are formed from a single piece of plastic film 75 such that the bottom edge 25 of the front wall 15 is joined seamlessly with the lower edge 55 of the back wall 45.

The first side edge 30 of the front wall 15 is attached to the first side edge 60 of the back wall 45 at a first side seam 80. The second side edge 35 of the front wall 15 is attached to the second side edge 65 of the back wall 45 at a second side seam 85. A perforation 90 is provided. The perforation 90 is spaced from the second side seam 85 and extends from the upper edge 50 of the back wall 45 to the lower edge 55 of the back wall 45. The perforation 90 joins the bag 10 to a subsequent bag 10*a*. First 17 and second 19 fold lines are provided. The first 17 and second 19 fold lines are parallel to the upper 50 and lower 55 edges and spaced from the upper 50 and lower 55 edges, respectively, by approximately one third of the first predetermined height 40. As illustrated in FIG. 17A, when separated from the subsequent bag 10*a*, the bag 10 will have a front wall 15 and a back wall 45 of substantially identical height.

Figure 18:
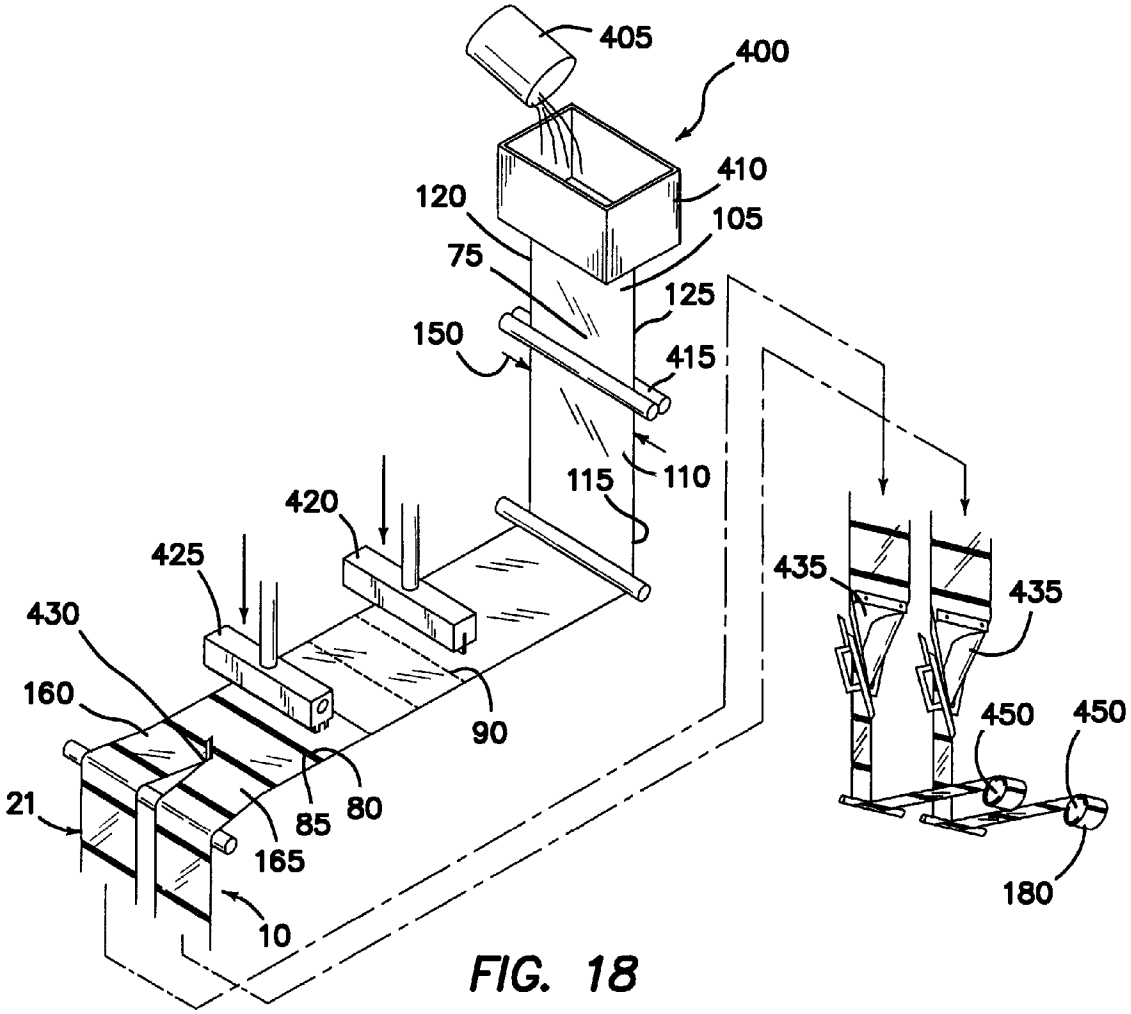
FIG. 18 is a perspective view of a first method of making the invention illustrating the flattening and slitting of the tube, perforating the tube, sealing the bag side edges, cutting the two facing bag streams apart, folding them in thirds and winding them on rolls.

(2) A method of making trifold side-seamed plastic produce bags 10, as illustrated in FIGS. 18 and 19 comprises the steps of: extruding a continuous tube 105 of thermoplastic film 75 and flattening the tube 105. The tube 105 has an upper surface 110, a lower surface 115, first 120 and second 125 side edges. Forming a perforation 90 perpendicular to the first 120 and second 125 side edges across an entire width 150 of the tube 105. Sealing the tube 105 at a first side seam 80. The first side seam 80 is spaced from and parallel to the perforation 90. Sealing the tube 105 at a second side seam 85. The second side seam 85 is spaced from and parallel to the first side seam 80. Cutting the upper surface 110 and the lower surface 115 to form two facing bag streams 160, 165, each of said bag streams 160, 165 having a first predetermined width 21. Folding each of the bag streams 160, 165 to approximately one third of the first predetermined width 21.

(3) In a variant of the method of making trifold side-seamed plastic produce bags 10, as illustrated in FIG. 19, the method includes the further step of corona treating 170 at least one of the upper surface 110 and the lower 115 surface of the flattened tube 105.

(4) In a further variant of the method, also illustrated in FIG. 19, the method includes the further step of printing advertising or informational material 175 on at least one of the corona treated 170 surfaces 110, 115 of the flattened tube 105.

(5) In still a further variant of the method, as illustrated in FIGS. 18 and 20, the method includes the further step of rolling each of the bag streams 160, 165 to form a bag roll 180.

(6) In yet a further variant of the method, as illustrated in FIG. 21, the method includes the further step of rolling each of the bag streams 160, 165 about a cylindrical core 185 to form a bag roll 190.

(7) In another variant of the method, as illustrated in FIG. 22, each of the bag streams 160, 165 is folded in a Z-fold configuration 23.

(8) In still another variant of the method, as illustrated in FIG. 23, each of the bag streams is folded in a C-fold configuration 27.

Figure 24:
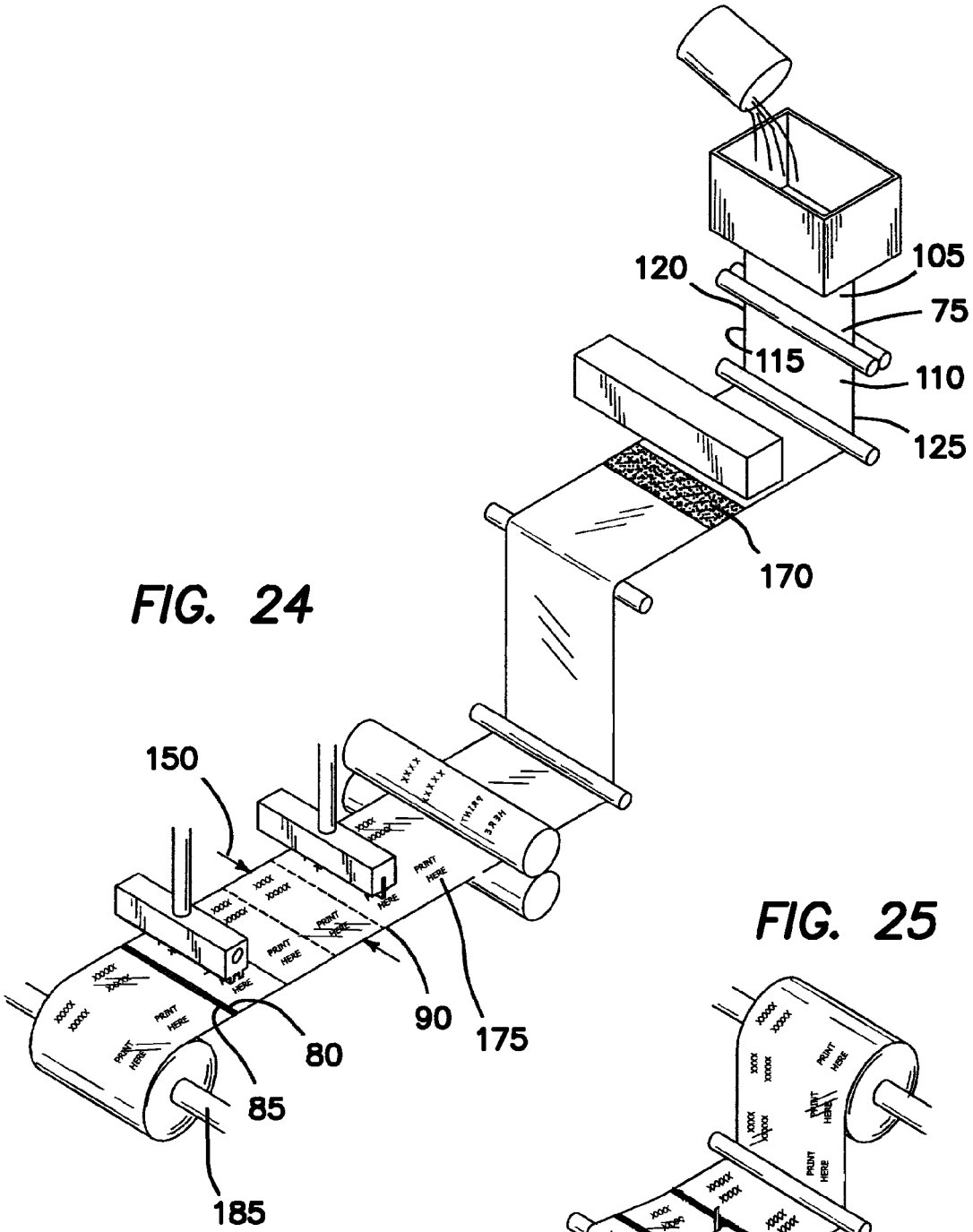
FIG. 24 is a perspective view of another method of making the FIG. 1 bags by corona treating, printing, perforating and sealing the tube and winding the tube onto a core for later separation into two facing bag streams.
Figure 25:
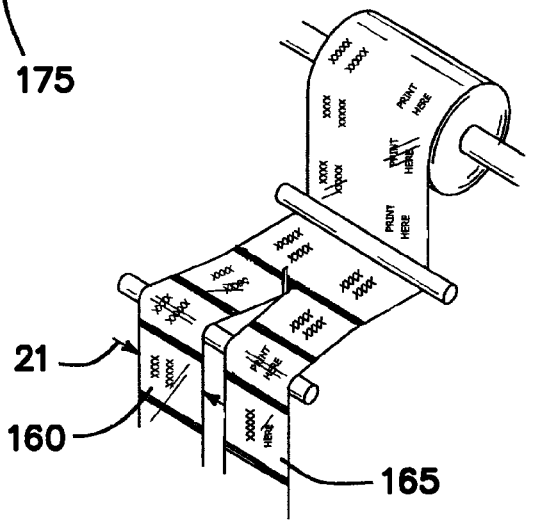
FIG. 25 is a perspective view of a second portion of the FIG. 24 process in which the printed tube, perforated and sealed tube is cut into two facing bag streams.

(9) In yet another variant of the method of making trifold side-seamed plastic produce bags 10, as illustrated in FIGS. 24 and 25, the method includes the steps of: Extruding a continuous tube 105 of plastic film 75 and flattening the tube 105. The tube 105 has an upper surface 110, a lower surface 115, first 120 and second 125 side edges. Corona treating 170 at least one of the upper surface 110 and the lower surface 115 of the flattened tube 105. Printing either advertising or informational material 175 on at least one of the corona treated 170 surfaces 110, 115 of the flattened tube 105. Forming a perforation 90 perpendicular to the first 120 and second 125 side edges across an entire width 150 of the tube 105. Sealing the tube 105 at a first side seam 80 spaced from and parallel to the perforation 90. Sealing the tube 105 at a second side seam 85. The second side seam 85 is spaced from and parallel to the first side seam 80. Winding the tube 105 onto a core 185 for later cutting of the upper surface 110 and the lower surface 115 to form two facing bag streams 160, 165, each of said bag streams 160, 165 having a first predetermined width 21. Folding each of the bag streams 160, 165 to approximately one third of the first predetermined width 21, as illustrated in FIG. 18.

(10) In still a further variant of the method, as illustrated in FIG. 20, the method includes the further step of rolling each of the bag streams 160, 165 to form a bag roll 180.

(11) In yet a further variant of the method, as illustrated in FIG. 21, the method includes the further step of rolling each of the bag streams 160, 165 about a cylindrical core 185 to form a bag roll 190.

(12) In another variant of the method, as illustrated in FIG. 22, each of the bag streams 160, 165 is folded in a Z-fold configuration 23.

(13) In still another variant of the method, as illustrated in FIG. 23, each of the bag streams is folded in a C-fold configuration 27.

Figure 27:
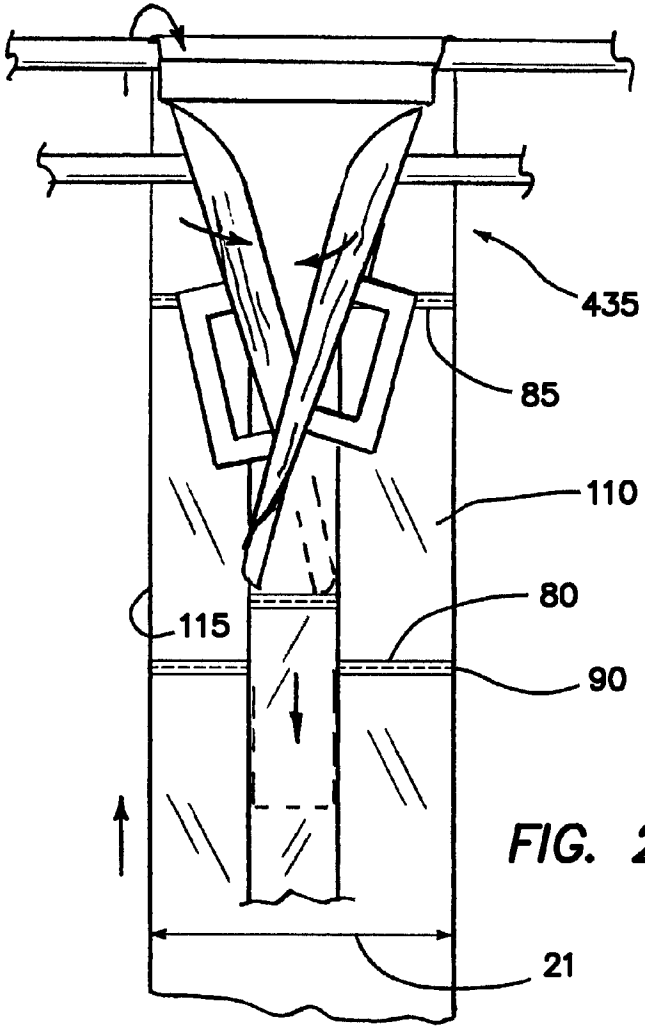
FIG. 27 is a detailed perspective view of the bag folding mechanism operating on a stream of trifold side seamed bags.
Figure 26:
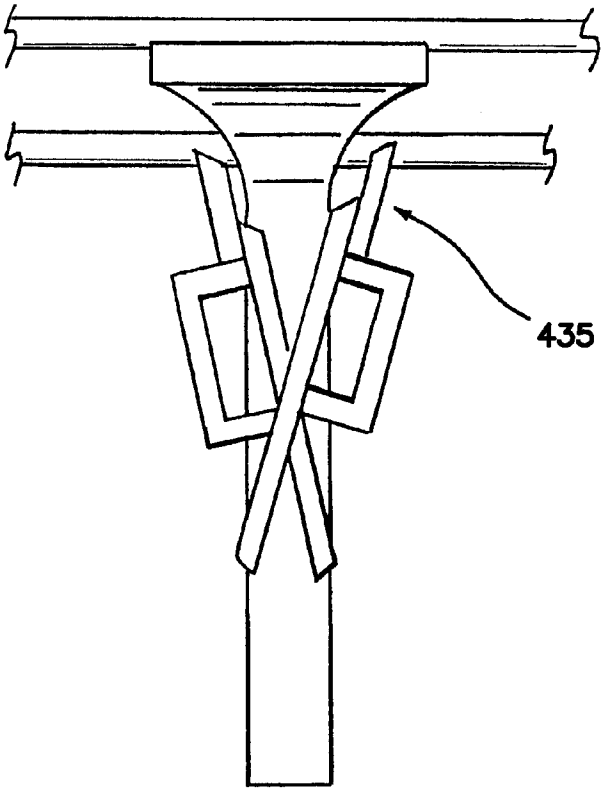
FIG. 26 is a detailed perspective view of a bag folding mechanism capable of folding a bag stream into thirds.

(14) As illustrated in FIG. 18, an apparatus 400 for making tri-fold side-seamed plastic produce bags 10 includes the following components. A supply of thermoplastic resin 405 is provided. An extruder 410 is provided. The extruder 410 is capable of extruding a continuous tube 105 of thermoplastic film 75. A tubing flattener 415 is provided. The flattener 415 is capable of flattening the tube 105. The tube 105 has an upper surface 110, a lower surface 115, first 120 and second 125 side edges. A perforator 420 is provided. The perforator 420 is capable of forming a perforation 90 perpendicular to the first 120 and second 125 side edges across an entire width 150 of the tube 105. A sealer 425 is provided. The sealer 425 is capable of sealing the tube 105 at a first side seam 80 spaced from and parallel to the perforation 90 and at a second side seam 85 spaced from and parallel to the first side seam 80. A slitter 430 is provided. The is slitter 430 is capable of cutting the upper surface 110 and the lower surface 115 to form two facing bag streams 160, 165. Each of the bag streams 160, 165 has a first predetermined width 21. A folder 435, as illustrated in FIGS. 18, 26 and 27, is provided. The folder 435 is capable of folding each of the bag streams 160, 165 to approximately one third of the first predetermined width 21.

(15) In another variant of the apparatus 400, as illustrated in FIG. 19, a corona treater 440 is provided. The corona treater 440 is capable of corona treating at least one of the upper 110 and lower 115 surface of the tube 105 prior to folding.

(16) In still another variant, a printer 445 is provided. The printer 445 is capable of printing advertising or informational material 175 on at least one of the corona treated surfaces 110, 115 of the flattened tube 105.

(17) In yet another variant, as illustrated in FIGS. 18 and 20, a bag rolling device 450 is provided. The bag rolling device 450 is capable of rolling each of the bag streams 160, 165 to form a bag roll 180.

(18) In a further variant, as illustrated in FIG. 21, a supply of cores 185 is provided. Each of the bag streams 160, 165 is wound around one of the cores 185 to form the bag rolls 190.

(19) In still a further variant, the folder 435 is capable of folding each of the bag streams 160, 165 in a Z-fold configuration 23, as illustrated in FIG. 22.

(20) In yet a further variant, the folder 435 is capable of folding each of the bag streams 160, 165 in a C-fold configuration 27, as illustrated in FIG. 23.

The Tri-fold side seamed produce bag 10 and methods and apparatus for making same have been described with reference to particular embodiments. Other modifications and enhancements can be made without departing from the spirit and scope of the claims that follow.

The invention claimed is:

1. A tri-fold side-seamed plastic produce bag, comprising:

a front wall, said front wall having a straight top edge, a bottom edge, a first side edge, a second side edge and a first predetermined height; straight a back wall, said back wall having a straight upper edge, a lower edge, a first side edge, a second side edge and said first predetermined height;

said straight top edge and said straight upper edge extending between said first and second side edges;

said front wall and said back wall being formed from a single piece of plastic film such that said bottom edge of said front wall is joined seamlessly with said lower edge of said back wall;

said first side edge of said front wall being attached to said first side edge of said back wall at a first side seam;

said second side edge of said front wall being attached to said second side edge of said back wall at a second side seam;

said straight top edge and said straight upper edge forming an open bag mouth;

a perforation, said perforation being spaced from said second side seam, extending from said upper edges of said front and said back walls to said lower edge and joining said bag to a subsequent bag;

first and second fold lines, said first and second fold lines being parallel to said upper and lower edges and spaced from said upper and lower edges, respectively, by one third of said first predetermined height; and whereby, when separated from said subsequent bag, the bag will have a front wall and a back wall of substantially identical height.

* * * * *